United States Patent [19]

Leem

[11] Patent Number: 4,573,571

[45] Date of Patent: Mar. 4, 1986

[54] PENCIL CASE

[76] Inventor: Tae Y. Leem, Flat 52-204, Walker Hill Apt., Kwangjang-dong, Sungdong-ku, Seoul, Rep. of Korea

[21] Appl. No.: 658,031

[22] Filed: Oct. 5, 1984

[51] Int. Cl.[4] ..... A45C 11/34; B65D 69/00

[52] U.S. Cl. ..... 206/214; 206/224; 206/457

[58] Field of Search ..... 206/214, 224, 457, 255, 206/380, 381; 229/8; D3/66; D19/82, 85; D99/35, 36, 37; 312/73

[56] References Cited

U.S. PATENT DOCUMENTS

| | | | |
|---|---|---|---|
| D. 39,883 | 3/1909 | Pearl | D3/66 |
| D. 83,668 | 3/1931 | de Sherbinin | D99/35 |
| D. 208,873 | 10/1967 | Skupien | D99/37 |
| D. 276,537 | 11/1984 | Tabachnik | D3/66 |
| 196,920 | 11/1877 | Meyers | 206/457 |
| 387,210 | 8/1888 | Cockings et al. | 206/214 |
| 629,586 | 7/1899 | McIntyre | 206/214 |
| 1,229,906 | 6/1917 | Decker | 229/8 |
| 1,791,340 | 2/1931 | Bailey | 206/255 |
| 2,329,375 | 9/1943 | Houlihan | 206/457 |
| 2,408,902 | 10/1946 | Beckstrom | 206/380 |
| 2,786,595 | 3/1957 | Nelson | 312/73 |
| 3,190,438 | 6/1965 | Cain et al. | 206/45.16 |
| 3,354,576 | 11/1967 | Gralnick | 206/457 |
| 4,142,627 | 3/1979 | Szegi | 206/1.7 |

FOREIGN PATENT DOCUMENTS

| | | | |
|---|---|---|---|
| 138190 | 8/1950 | Australia | 206/443 |
| 370674 | 8/1963 | Switzerland | 206/443 |
| 1002 | of 1893 | United Kingdom | 206/214 |
| 988602 | 4/1965 | United Kingdom | 206/443 |
| 1593152 | 7/1981 | United Kingdom | 206/214 |

*Primary Examiner*—William T. Dixson, Jr.
*Assistant Examiner*—Brenda J. Ehrhardt
*Attorney, Agent, or Firm*—Holman & Stern

[57] ABSTRACT

A new case for colored pencils is provided, which is formed by a cylindrical main case, a cone-shaped upper cap, and a bottom cap. The bottom cap is screwed to the case and functions to lift and lower the pencils in the case supported upright on the bottom cap so that users can easily pick up a piece of selected colored pencil. The bottom cap is also provided with a coin slit and, therefore, the case may be used as a coin saving box after wasting all the pieces of the pencils contained in the case.

5 Claims, 3 Drawing Figures

PENCIL CASE

BACKGROUND OF THE INVENTION

This invention relates to a pencil case and more particularly to a case for colored pencils, which facilitates freely picking up individual colored pencils therefrom and discriminating them from each other by color and can benefitably be used as a saving box after a complete use of the pencils.

Hitherto, a dozen of corored pencils are packaged in a rectangular flat hexahedral case which may be made of paper or synthetic resin and provided with separate pockets or spaces for adapting individual colored pencils. Therefore, the pencils must be packaged with a single file arrangement; this has defects in that the case requires a broad area when carrying or preserving them, must be discarded after a complete waste and is inconvenient in use on a thing such as a desk.

SUMMARY OF THE INVENTION

The object of the invention is to provide a new case for colored pencils which has eleminated all drawbacks encountered in prior art pencil cases and has utility as a saving box.

The object and the advantages of the invention can be attained by providing in accordance with the invention a pencil case comprising a cylindrical main case with the circumferential grooves formed at the upper and the lower end portions of the inside of said case; a cone-shaped upper cap, said upper cap being removably adapted in said upper end circumferential groove; and a pencil lifting and lowering control cap, said control cap being provided with a threaded protrusion around the outside surface thereof, and a upright top-end open cyrindrical protrusion formed at the center of said control cap and having an inner base surface higher than that of said control cap.

DETALED DESCRIPTION OF THE INVENTION

Figure 1:
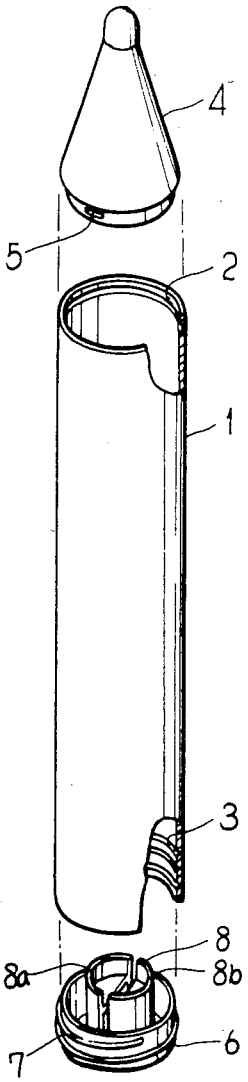
FIG. 1 is a perspective view partially cut away of the pencil case in accordance with the invention.
Figure 2:
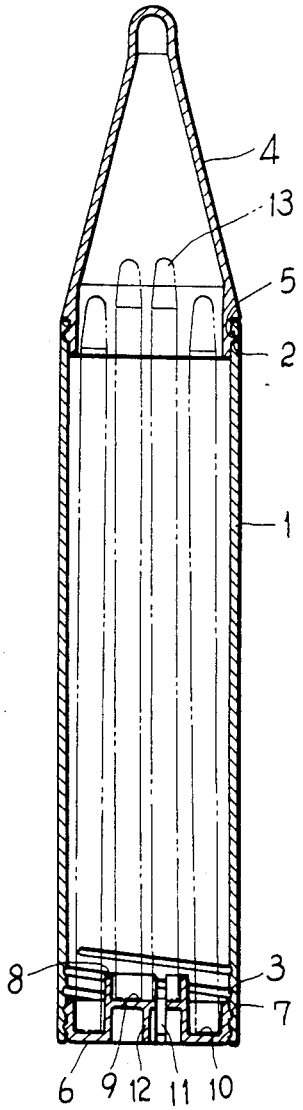
FIG. 2 is a longitudinal cross-sectional view of the pencil case as shown in FIG. 1.
Figure 3:
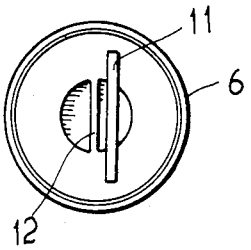
FIG. 3 is a bottom plane view of the pencil case as shown in FIG. 1.

Referring now to FIGS. 1 through 3, a plastic cylindrical case 1 is provided which functions as a case for packaging colored pencils. The case 1 is provided with grooves 2 and 3 which are independently formed circumferentially on the inner surfaces of the upper and the lower portions of the case. The case 1 is also capped resilently with a cone-shaped cap 4 at the upper mouth thereof. The cap 4 can removably be capped to the case 1 by means of an engagement of the groove 2 and a protrusion 5 formed intermitently around the skirt of the cap 4. At the lower mouth of the case 1, a bottom cap 6 is screwed. The cap 6, which can lift and lower the position of the pencils contained in the case 1, is provided with a threaded protrusion 7 around the outer circumference thereof which is engaged with the grooves 3 when screwing. From the center of the inner surface of the cap 6, there is protruded upright a short cylindrical protrusion 8 which may be preferably divided vertically into two half portions. 8a, 8b, in such a manner that the height of the inner base surface 9 of the protrusion 8 can be positioned at the higher level than that of the inner base surface 10 of the cap 6. The cap 6 is also provided with a coin slit 11. Numerical FIGS. 12 and 13 denote a knob for turning the cap 6 and pencils contained in the cap 6, respectively. In accordance with the invention, the lower mouth of the case 1 is screwed by the bottom cap 6. Thereafter, a desired number of pencils, preferably a dozen of pencil is put into the case 1 and, then, the case 1 is covered with the upper cap 4. When picking up any colored pencil 13, one can open the upper cap 4 and, then, grasp the case 1 by one hand, turning the bottom cap 6 clockwise by means of the know 12, so that the pencils 13 contained in the case 1 can be lifted upward. By doing so, the tips of the pencils 13 are exposed out of the upper edge of the case 1. At that time, the pencils positioned upright on the open-end cylindrical protrusion 8 can, as shown in FIG. 2, be raised higher than those positioned upright on the groove 10 around the protrusion 8. Therefore, it is possible to readily pick up only any selected colored pencil from the case 1.

After having wasted all of the pencils, one can use the case 1 as a coin saving box by securing the upper cap 4 and the bottom cup 6 to the case 1 by aid of an adhesive. For the purpose, coins can be put into the case 1 through the coin slit 11 provided in the bottom cap 6.

I claim:

1. A pencil case comprising a cylindrical body member having upper and lower ends, a removable first cap for the upper end of the body member, the lower end of the body member being formed with an internal circumferential thread and the case further including a second cap for the lower end of the body member, the second cap having an outer circumferential thread complimentary to the internal thread of the body member for threading the cap into and out of the lower end of the body member, the second cap having a central internal protrusion defining an internal annular base wall portion around the protrusion for the receipt of on-end pencils and a central wall portion above the base wall portion for the receipt of further on-end pencils at a higher level than the pencils received on the annular portion, the second cap further being provided with engagement means for manually threading the second cap into and out of said body member to raise and lower the pencils in the case.

2. The invention of claim 1 wherein the central protrusion in the second cap defines a cup-like recess on the exterior of the cap and the engagement means comprises a rib extending across the recess.

3. The invention of claim 1 wherein the second cap is further formed with a coin slit for use of the case as a coin box on removal of the pencils.

4. The invention of claim 1 wherein the central protrusion of the second cap has a projecting peripheral wall around the central wall portion.

5. The invention of claim 1 wherein the first cap is of conical form and the case includes means for threading the first cap onto and off of the upper end of the body member.

* * * * *